United States Patent [19]

Drews et al.

[11] 4,171,692

[45] Oct. 23, 1979

[54] FUEL INJECTION CONTROL SYSTEM

[75] Inventors: Ulrich Drews, Vaihingen-Pulverdingen; Lothar Winkelmann, Ludwigsburg; Peter Werner, Stuttgart, all of Fed. Rep. of Germany

[73] Assignee: Robert Bosch GmbH, Stuttgart, Fed. Rep. of Germany

[21] Appl. No.: 713,130

[22] Filed: Aug. 10, 1976

[30] Foreign Application Priority Data

Aug. 12, 1975 [DE] Fed. Rep. of Germany ..... 2535918

[51] Int. Cl.[2] ..... F02D 1/04; F02D 1/06

[52] U.S. Cl. ..... 123/140 MC; 123/32 EG

[58] Field of Search ..... 123/140 MC, 32 EG, 32 EA, 123/179 L, 179 G

[56] References Cited

U.S. PATENT DOCUMENTS

| | | | |
|---|---|---|---|
| 3,646,917 | 3/1972 | Nagy | 123/32 EA |
| 3,847,130 | 11/1974 | Miyoshi et al. | 123/32 EG |

*Primary Examiner*—Charles T. Jordan

*Attorney, Agent, or Firm*—Edwin E. Greigg

[57] ABSTRACT

A control circuit for a fuel injection system which modifies the control pulses of the electromagnetic valves during engine starting. The width of the normal injection control pulses determines the amount of fuel and is derived from engine parameters, in particular rpm and air flow rate. When stating the engine, the control circuit is actuated by the starting switch of the engine and causes suppression of the normal control pulses. A multivibrator generates substitute starting control pulses whose duration is changed by altering the time constant of the multivibrator in response to the signal from a temperature transducer.

13 Claims, 8 Drawing Figures

PULSE GENERATOR
TRIGGER
PULSE WIDTH MULTIPLIER
R28
D17
R26
R25
R30
T19
Ut
R2
D2
D5
R14'
R3
B1
C1
D3
R6
R15'
R5
R7
R13
R12
R1
D1'
Ua
tp
P2
T3
T5
R15
T6
R4
T2
T1
T4
R10
R9
P1
R8
R11
D4
C2
2b

FUEL INJECTION CONTROL SYSTEM

BACKGROUND OF THE INVENTION

The invention relates to a method and an apparatus for controlling the amount of fuel delivered by a fuel injection system to an internal combustion engine during engine starting.

The fuel injection system includes a first pulse generator circuit which generates preliminary pulses proportional to the aspirated air quantity and rpm. The system includes a multiplying circuit connected in series with the pulse generator circuit and both of these circuits contain capacitors which control multivibrators.

It is known to provide an electronic fuel injection system in which the duration of the control pulses for the various fuel injection valves is determined substantially from the load of the engine at any given time and the instantaneous rpm. A circuit, which will be explained in more detail below, uses these two variables to provide a so-called preliminary pulse. However, when the variables which define the duration of these pulses, i.e., the rpm and the load, assume unfavorable values, which can be derived from the air flow rate of the engine, the control pulses can fall in a critical domain where imprecise fuel metering may occur.

During the starting of an internal combustion engine, the prevailing engine speed and the aspirated air quantity are such that, in certain fuel injection systems, the air flow rate meter as well as the electronic circuitry which produces the preliminary injection pulses and will be called a control multivibrator in what follows, are insufficiently accurate for the requirements of smooth engine operation.

Thus, in order to obtain an optimum fuel-air mixture during the engine starting, the injection timing must take into account the engine temperature which, as is well known, plays a considerable role in the success of the starting process.

OBJECT AND SUMMARY OF THE INVENTION

It is a principal object of the invention to provide a fuel injection system for internal combustion engines in which the fuel-air mixture is adjusted by considering the engine temperature during the starting process.

This object is attained according to the invention by providing that during the starting process the fuel injection control pulses may be interrupted or otherwise made ineffective. The invention further provides an adjustable monostable multivibrator which is triggered by rpm-dependent pulses and whose time constant is partially determined by the engine temperature. The invention further provides that the output pulses from the multivibrator are fed to a multiplier circuit and hence to the fuel injection system itself.

It is an advantage of the invention that the control of the injection timing is performed by a supplementary system only during the actual starting process. After the starting switch has been released or opened, the electronic fuel injection system reverts to its normal mode of operation. It is assumed that, at the point where the engine begins to operate on its own, the air flow rate and the rpm are both high enough so as to be capable of sensing to generate usable data.

Inasmuch as the time constant of a monostable multivibrator may be set extremely precisely and is furthermore made dependent on engine temperature, very accurate starting control pulses may be generated and these may, of course, also be adapted to a particular engine type.

In a preferred embodiment of the present invention, there may be provided a circuit which limits the pulse duration of the fuel control pulses to a minimum value. Such a circuit is suitable if the basic values of rpm and load require a very low amount of fuel in relation to the aspirated air quantity so that a critical condition may result in which the mixture no longer combusts in the cylinder. Unfavorable rpm and load values of this type may occur, for example, during downhill coasting at high rpm and low load.

The invention will be better understood as well as further objects and advantages thereof become more apparent from the ensuing detailed specification of two preferred embodiments taken in conjunction with the drawing.

DESCRIPTION OF THE PREFERRED EMBODIMENTS

Figure 1:
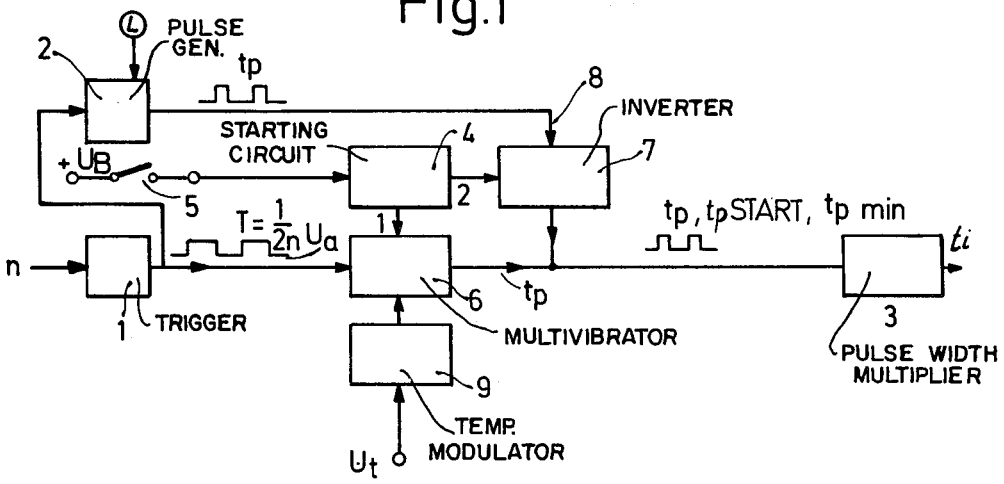
FIG. 1 is a simplified block diagram of the apparatus according to the invention.

Turning now to FIG. 1, there will be seen a simplified block diagram of the principal construction of a fuel injection system including the elements provided according to this invention. The system shown includes a trigger circuit 1 to which is fed an rpm-dependent signal and from which there is obtained a trigger pulse train $U_a$ whose frequency is proportional to the rpm and whose keying ratio is one-half. The pulse duration T of this pulse train $U_a$ is equal to 1/2n and thus is associated with a particular type of internal combustion engine, namely a four-cylinder engine having a particular type of injection. It is to be understood that other rpm-proportional trigger pulse trains can be used. The triggering pulses $U_a$ are fed firstly to a pulse generator circuit 2 which will henceforth be referred to as a control multivibrator circuit. The control multivibrator circuit receives information regarding the aspirated air flow rate and, triggered by the triggering circuit, delivers output pulses $t_p$ whose duration determines the length of the final injection control pulses. For this purpose, the control multivibrator includes a monostable multivibrator whose timing capacitor is located in a feedback branch. The time constant of the monostable multivibrator is defined by the charge exchange time of the capacitor which, in turn, is determined by a discharge current source and a charging current source. The discharge current is used as a measure for the air quantity provided to the engine and the normally constant charging current is turned on for a period of time inversely proportional to the engine rpm prior to the discharging process, so that the amount of charge stored in the capacitor is a measure of the engine rpm. In the normal case, the output pulses $t_p$ directly reach the second circuit 3 in the fuel injection system which will henceforth be called a multiplying circuit 3. This circuit has the job to at least double the duration of the pulses $t_p$ in a particular embodiment and also to offer opportunities for adapting the pulses to particular operational engine conditions.

Normally, these corrections are made in the multivibrator circuit and may affect the pulse duration substantially. In the present case however the otherwise known fuel injection system is so engaged that when certain operational conditions prevail, namely during the start-up of the engine, the influence of the preliminary pulse sequence delivered by the control multivibrator 2 is interrupted and is replaced by the pulses of a definite duration which are generated by the circuit according to the invention. That circuit includes a starting circuit 4 which engages the fuel injection system during the engine starting phase and which is actuated, for example, by an appropriate control voltage provided by the starting switch 5. That voltage may be, for example, the positive battery potential $U_b$. The starting circuit 4 acts in a double manner, firstly it blocks the preliminary pulses $t_p$ generated by the control multivibrator 2 and, secondly, it releases the output of a monostable multivibrator 6. The monostable multivibrator 6 is preferably a so-called economy monostable multivibrator and is also triggered by the triggering circuit 1.

The suppression of the preliminary control pulses from the control multivibrator 2 may take place by having the starter circuit 4 block the output of an inverter circuit 7 through which the preliminary control pulses $t_p$ must travel to reach the input of the multiplier circuit 3. In another embodiment to be described later (FIGS. 3 and 4) the pulse sequence from the control multivibrator is compared with that from the monostable multivibrator 6 in an OR gate and the pulse of longer duration is fed to the input of the multiplying circuit 3. In the normal case, the output pulses $t_{pstart}$ from the monostable multivibrator 6 are longer than the pulses $t_p$ from the control multivibrator circuit. If for any reason, the pulse $t_{pstart}$ is shorter than the pulse $t_p$, the circuit according to the invention makes it possible to so engage the control multivibrator circuit as to shorten the pulses $t_p$ during the engine starting phase.

Figures 2, 2A, 2B:
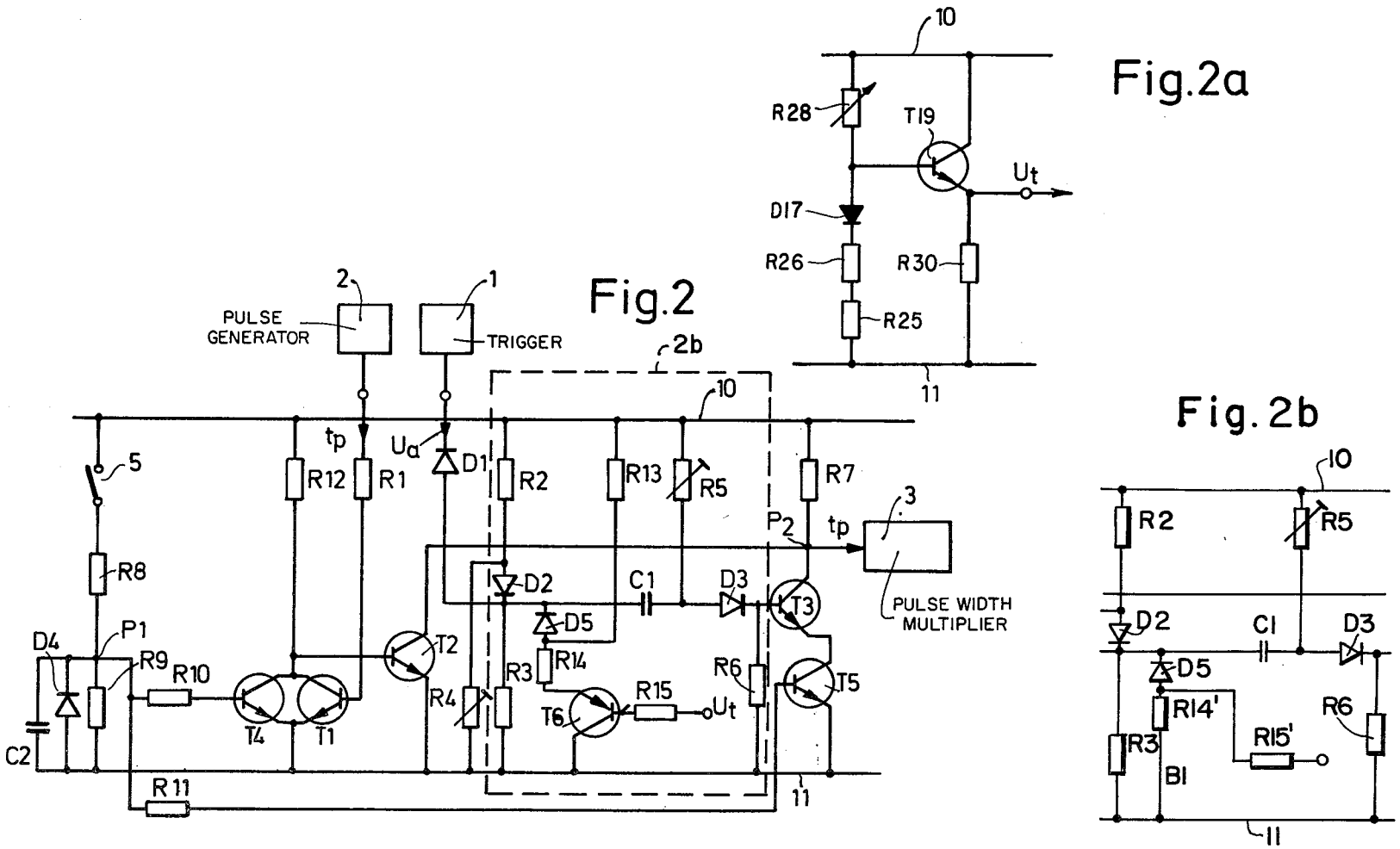
FIG. 2 is a detailed schematic diagram of a first exemplary embodiment of the invention.
FIG. 2*a* is an exemplary circuit for generating a temperature-dependent voltage to be used in the apparatus.
FIG. 2*b* is an alternate embodiment to that of FIG. 2, but illustrating only that portion of the circuit which differs.

Associated with the monostable multivibrator 6 is a warm-up coupler circuit 9 which provides the monostable multivibrator with an engine temperature-related potential derived from a suitable transducer. Thus, the time constant of the monostable multivibrator 6 is affected in addition to the usual adjustments. In the simplest case, the thermotransducer may be a suitable temperature-dependent element which delivers an output voltage $U_t$ as a function of engine temperature. Such elements are generally known and need not be explained in detail, for example they may be a thermal element or a temperature-dependent resistor located in the cooling system of the engine whose resistance change is suitably exploited. An example of a circuit suitable for generating a temperature-dependent voltage $U_t$ is shown in FIG. 2*a*. Turning now to FIG. 2, there is illustrated a detailed circuit diagram of the circuit according to the invention including blocks for the trigger circuit 1, the control multivibrator 2 and a multiplying stage 3, all previously referred to.

The monostable multivibrator 6 includes a transistor T3 whose collector is connected to the positive supply line 10 through a resistor R7 and whose emitter is connected to the collector of a further transistor T5 whose own emitter is grounded at the negative supply line 11. It will be understood that the polarity of the supply lines 10 and 11 could be reversed if other elements of the circuit are suitably chosen. The base of the transistor T3 is connected through a resistor R6 to the negative line 11. The monostable multivibrator 6 also includes a diode D3 whose cathode is connected to the base of the transistor T3 and a timing capacitor C1 connected to the anode of the diode D3. The junction of the capacitor C1 and the diode D3 is connected to the positive line 10 through an adjustable resistor R5. The opposite end of the capacitor C1 is connected to a diode D1 through which a pulse train $U_a$ from the trigger circuit 2 flows through the capacitor C1 to the transistor T3, as well as to resistors R2,R3, R4 and a further diode D2. One of the electrodes of the resistor R2 is connected to the positive line 10, while its other electrode is joined to the junction of the adjustable resistor R4 and the diode D2 whose cathode is connected to the junction of the capacitor C1 and the diode D1. A resistor R3 is connected between the negative line 11 and the cathode of diode D2.

The starter circuit 4 includes the just-mentioned transistor T5 connected to the emitter of the transistor T3 and a further transistor T4 whose emitter is grounded or connected to the negative line 11 while its collector is connected through a resistor R12 to the positive line 10. The base electrodes of the transistors T4 and T5 are connected, through resistors R10 and R11 respectively, to a common junction P1 which is supplied with positive potential, in the present example through a resistor R8 from the starter switch 5. For the purpose of suppressing negative voltage peaks and for filtering out disturbing potentials as well as for a precise voltage adjustment, the junction P1 is connected to the negative line 11 through the parallel connection of a capacitor C2, a diode D4 and a resistor R9.

Finally, the inverter stage includes a transistor T1 connected in parallel with the transistor T4; the base of the transistor T1 is connected through a resistor R1 to the control multivibrator 2 from which it receives the signal train $t_p$. The inverter stage further includes a transistor T2 whose emitter is connected to the negative line and whose collector is connected to the junction of the collector of transistor T3 and the resistor R7, labeled P2 in FIG. 2. The junction P2 also serves as the output connection of the monostable multivibrator 6 from which the multiplier stage 3 receives the starting pulses $t_{pstart}$.

Also shown is the above-mentioned warm-up coupler circuit 9 which, in the present illustrated exemplary embodiment, includes two variant arrangements. Both of these arrangements share the diode D5 whose cathode is attached to the junction of the capacitor C1 and the diodes D1 and D2.

The two alternative ways in which the engine temperature-dependent potential $U_t$ may be applied to the circuit is as follows: In the first manner of connection, the temperature-dependent potential $U_t$ is transmitted through a resistor R15 to the base of a transistor T6 whose collector is connected to the minus line 11 and whose emitter is connected through a resistor R14 to the other side of the diode D5. The junction of the resistor R14 and the diode D5 is connected through a resistor R13 to the positive line 10.

The second manner of connecting the thermal signal is shown in FIG. 2*b*, and it is to omit the transistor T6 and the resistor R13. The resistor R15, which is now designated R15' and may have some other value, is connected directly to the junction of the resistor R14' and the diode D5; the other side of the resistor R14' is connected to the negative line 11. The manner of operation of the circuit of FIG. 2 is as follows: When the starting switch is not actuated, i.e., during the whole time of normal vehicle operation, the base electrodes of the transistors T4 and T5 carry negative potential so that these transistors are blocked. Accordingly, the transistor T3 does not carry an output signal nor does the economy multivibrator since it can assume no definite switching state. As long as transistor T4 is blocked, the parallel transistor T1 operates normally and thus conducts the preliminary pulse sequence $t_p$ to the transistor T2 which in turn delivers it unchanged at the point P2 and feeds it to the multiplier circuit 3.

The circuit of FIG. 2 assumes its second switching state when the starter switch 5 is closed so that the transistors T4 and T5 both conduct since their bases are provided with a positive voltage. The conduction of the transistor T4 causes the base of the transistor T2 to be grounded which blocks it, so that the preliminary pulse train $t_p$ is interrupted and cannot pass. The conducting transistor T5 acts as a normal path from the emitter of the transistor T3 to ground, diminished merely by the saturation voltage of the transistor T5. Thus, the output of the multivibrator is released to deliver the pulse sequence $t_{pstart}$ which is now transmitted as a control signal to the multiplier stage 3.

The economy multivibrator is triggered by the output from the triggering circuit 1 which delivers a triggering pulse sequence $U_a(T=\frac{1}{2}n)$, which insures that the onset of the pulse $t_{pstart}$ occurs at the same time as the pulse $t_p$ of the control multivibrator circuit 2. A positive-going pulse from out of the triggering pulse sequence $U_a$ locks the diode D1 and the transistor T3, which is normally conducting, remains in that state. The capacitor C1 charges to a voltage which results in a potential distribution appropriate for the switching state. The negative voltage jump at the rear flank of the positive triggering pulse travels through the capacitor C1 to the diode D3 and blocks it so that the transistor T3 is also blocked. Thus the junction point P2 at the output of the circuit carries a positive pulse whose duration is equal to the blockage time of the transistor T3 and constitutes the pulse duration of the starting pulses $t_{pstart}$.

The transistor T3 remains blocked until the current flowing through the adjustable resistor R5 has discharged the capacitor whose time constant is $\tau = R5 \cdot C1$ until the voltage at the anode of the diode D3 returns the transistor T3 to the conducting state, whereafter the entire circuit returns to its normal condition.

The starting pulse sequence $t_{pstart}$ is influenced by the potential $U_t$ from the thermal transducer section of the engine by changing the maximum charge of the of the capacitor C1. This maximum charge, i.e., the voltage across the capacitor C1 just prior to the arrival of the negative voltage jump which blocks the transistor T3, effectively determines the discharge time of the capacitor C1 until the renewed conduction of the transistor T3.

FIG. 2*a* illustrates a circuit which may be used to generate a temperature-dependent potential. In the exemplary embodiment shown there, an NTC resistor R25 is located in or near the cooling water of the engine and is connected in series with a resistor R26, a diode D17 and a further adjustable resistor R28 between the plus and minus supply lines. The junction of the resistor R28 and the diode D17 is coupled to the base of a transistor T19 whose collector is at positive potential while its emitter is connected through a resistor R30 to the negative supply line 11. The NTC resistor R25 changes its resistance in such a manner that, when the engine is at a lower temperature, the potential $U_t$ increases. This potential is delivered to the input of the warm-up coupling circuit represented by the free electrode of the resistor R15—R15'. The operation of this part of the circuit is as follows: The potential from the voltage divider R2, R4 and the series connection of the diodes D2 and the resistor R3, which previously defined the maximum charge of the capacitor C1, is now replaced by a variable potential from the warm-up coupler circuit. This happens because, as the input voltage to the transistor T6 becomes greater, that transistor conducts less and less so that the potential at the junction of the resistor R14 and the diode D5 increases in the positive direction until the diode D5 conducts, whereas the diode D2 is caused to block. From this point on, and for all lower temperatures, the voltage drop across the resistor R3 is determined by the output voltage $U_t$ from the thermal coupler, i.e., the output voltage provided by the circuit of FIG. 2*a*.

It will be seen that the same effect is obtained if the two connecting bridges B1 and B2 (FIG. 2*b*) are present since the resistor R15' is then connected directly to the anode of the diode D5 and can influence its behavior. By suitable choice of the resistors R13 as well as R14 and R15 in one case, or R14' and R15' in the other case, the voltage is changed according to the function $t_{pstart}=f$ (engine temperature). The resistors R5 and R4 serve for fine adjustment.

Figure 3:
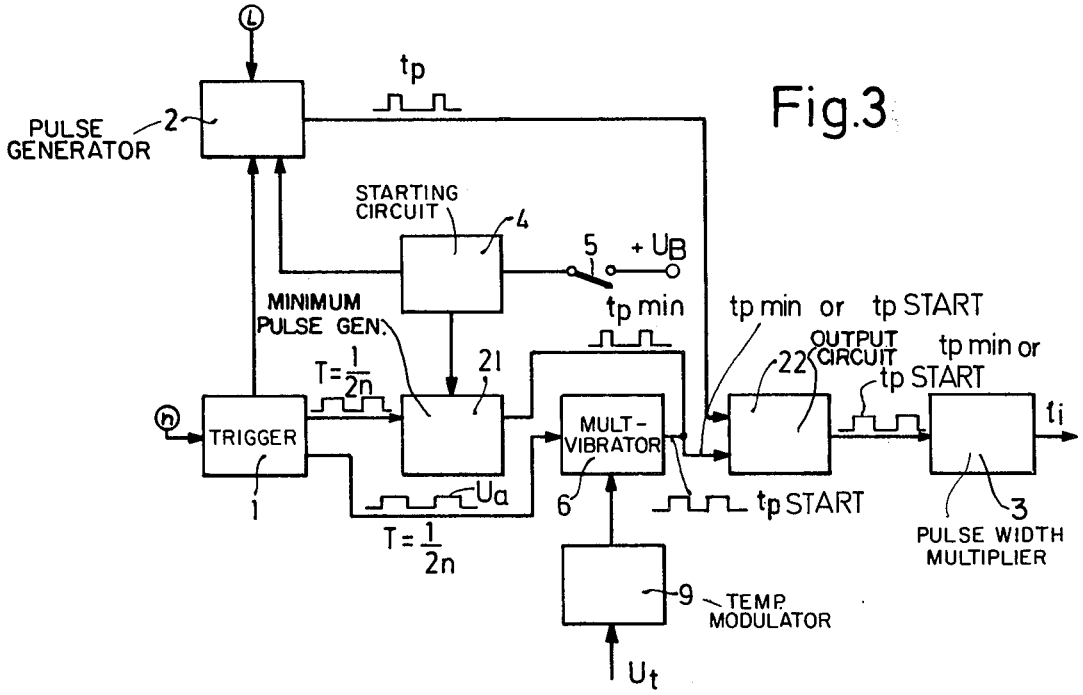
FIG. 3 is a simplified block diagram of a second exemplary embodiment of the invention including a circuit for generating pulses of minimum duration.

A second exemplary embodiment of the invention is illustrated in the form of a block diagram in FIG. 3. The circuit according to the invention here includes a subcircuit which limits the pulse duration of the preliminary pulses $t_p$ to a minimum value $t_{pmin}$.

Figure 4:
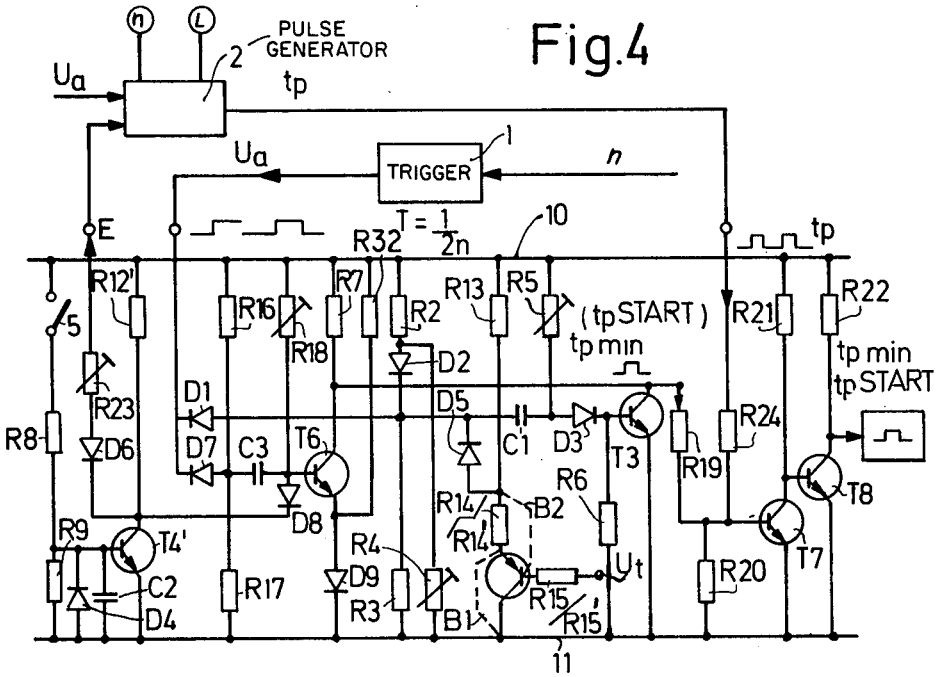
FIG. 4 is a detailed circuit diagram of the second exemplary embodiment of the invention.

The circuit of FIG. 3 differs from that of FIG. 1 in that it has a different output circuitry 22 and also includes a supplementary circuit 21 for generating a $t_{pmin}$ pulse which is independent of rpm and load. The starting circuitry is also modified. FIG. 4 is a detailed circuit diagram of a second embodiment of the invention and those circuit elements which are the same as in FIG. 2 have the same reference numerals.

The circuitry which generates the pulse train $t_{pmin}$ includes a monostable multivibrator and is built in a manner similar to that of the economy multivibrator 6 in the circuit which generated the pulse sequence $t_{pstart}$ for engine starting. It includes a transistor T6 whose collector is connected to the same collector resistor R7 as is the transistor T3 and whose emitter is connected through a diode D9 to the negative line 11. The emitter of the transistor T6 is also connected through a resistor R32 to the positive line 10. The transistor T6 is controlled via a capacitor C3 whose charging and discharging properties define the time constant of the economy multivibrator and hence determine the duration of the $t_{pmin}$ pulses. In order to adjust the desired pulse duration, the junction of the base of the transistor T6 and the capacitor C3 is connected through an adjustable resistor R18 to the positive line while the other side of the capacitor C3 is connected to the junction of resistors R16 and R17 which form a voltage divider connected between the positive and negative supply lines. Connected to the same junction point is a diode D7 which may be considered to be in parallel with the diode D1 inasmuch as both diodes receive the same triggering pulse sequence $U_a$ from the triggering circuit 1. As may be seen, the two sub-circuits, i.e., the circuit which provides the pulse train $t_{pmin}$ and that which provides the pulse train $t_{pstart}$ operate in a generally parallel manner through a common resistor R19 on the subsequent gating circuitry. This gating circuitry includes the transistors T7 and T8 whose emitters are at negative potential and whose collectors are at positive potential via resistors R21 and R22, respectively. The collector of the transistor T7 is connected directly to the base of the transistor T8 which is a pure inverter. The output pulse sequence $t_p$ from the control multivibrator circuit 2, which is used in normal operation, travels through a resistor R24 to the base of the transistor T7 and that base is also connected through a resistor R20 to the negative line 11.

The starter switch 5 controls the base of a transistor T4' whose collector is connected to the plus line 10 through a resistor R12' and through a diode D8 with the base of the transistor T6 in the circuit which generates the $t_{pmin}$ pulses. The collector of the transistor T4' is also connected through a diode D6 and a series potentiometer R23 to the control input of the control multivibrator circuit 2.

During the engine starting phase, i.e., during the operation of the starter motor, the transistor T6 is blocked by the potential from the conducting transistor T4' arriving through the diode D8. Thus, the output of the transistor T3 in the economy multivibrator which generates the pulse sequence $t_{pstart}$ is released. The multiplier circuit 3 is thus controlled by the starting pulses since the normal preliminary pulses $t_p$, which arrive at the base of the transistor T7 at the same time, are of shorter duration and, as may be seen, the base of the transistor T7 automatically receives that positive trigger pulse which has the longer duration.

Alternatively, if the pulses $t_p$ from the control multivibrator 2 are longer than those pulses $t_{pstart}$ required for engine starting, it is possible to reduce the pulse width of the pulses $t_p$ during the starting phase, namely by applying a negative potential to a control input of the multivibrator circuit 2, i.e., through the resistor R23, so that the discharge current in that circuit is increased, which leads to a shortening of the preliminary pulses $t_p$.

Figure 5:
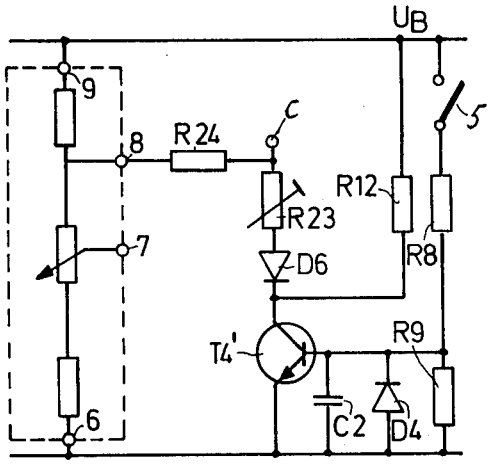
FIG. 5 illustrates a circuit for prolonging the starting control pulses independently of engine temperature.
Figure 6:
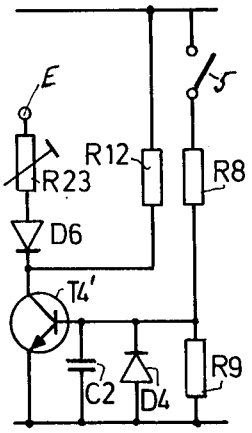
FIG. 6 illustrates a circuit for starting control and shortening of the starting control pulses independently of engine temperature.

FIG. 5 illustrates a sub-circuit for prolonging the duration of the pulse $t_p$ and FIG. 6 illustrates a subcircuit for shortening the duration of the pulse $t_p$ during the engine starting phase. The circuit of FIG. 6 has already been mentioned in connection with the description of FIG. 4, and the point E is connected directly to the control multivibrator circuit. The circuit of FIG. 5 operates as follows: During the engine starting phase, the transistor T4 conducts and the potential at the input C of the control multivibrator is reduced by the voltage drops across the trimmer resistor R23, the diode D6 and the conduction path of the transistor T4'. The potential at the point E of the control multivibrator, to which the resistor which defines the discharge current is also connected, is reduced by the same amount. Due to the reduced voltage drop across the current-determining resistor, the discharge current is small and thus the pulse length of the pulse $t_p$ is reduced during the engine starting phase.

The foregoing relates to preferred exemplary embodiments of the invention, it being understood that variants thereof are possible within the spirit and scope of the invention, the latter being defined by the appended claims.

What is claimed is:

1. In an apparatus for controlling the fuel injection system of an internal combustion engine equipped with a starter and with fuel injection valves, said fuel injection system including means for generating primary control pulses for actuating said fuel injection valves, and further including starter circuit means, for interrupting the transmission of said primary control pulses to said fuel injection valves during engine starting; the improvement comprising:

multivibrator means triggered by rpm-dependent pulses, for generating substitute control pulses of adjustable duration and for delivering said substitute control pulses to the same said fuel injection valves during engine starting; and means responsive to engine temperature for generating a continuously variable signal which is delivered to said multivibrator means to alter the time constant thereof; whereby said fuel injection valves are actuated by said substitute control pulses during engine starting and by said primary control pulses at all other times.

2. An apparatus as defined by claim 1, further comprising an inverter circuit for receiving said control pulses and a multiplying circuit connected thereto for transmitting control pulses to the fuel injection valves, said inverter circuit being activated by the starter switch of the engine to block transmission therethrough.

3. An apparatus as defined by claim 1, wherein said starter circuit means includes a first transistor controlled by the engine starting switch, and a second transistor also controlled by said engine starting switch, and wherein said multivibrator means includes a third transistor which is connected in series with the switching path of said second transistor to ground.

4. An apparatus as defined by claim 3, wherein there is connected in parallel with said first transistor a transistor (T1) belonging to said inverter circuit and wherein the joined collectors of said first transistor and said transistor (T1) are joined to the base of a second transistor (T2) belonging to said inverter circuit, the collector of said transistor (T2) being joined to the collector of said transistor (T3) of said multivibrator means.

5. An apparatus as defined by claim 1, wherein said multivibrator means includes a transistor (T3) whose collector is connected through a resistor to a positive supply line and whose base is controlled by a capacitor receiving triggering signals.

6. An apparatus as defined by claim 5, further comprising voltage divider means connected to said capacitor to provide charging thereof, said voltage divider means including two resistors and a diode in series connected between the positive and negative supply lines of the circuit, the junction of said diode and one of said resistors being joined to said capacitor and the anode of said diode being connected to the negative supply line through an adjustable resistor (R4).

7. An apparatus as defined by claim 1, wherein the output from said means responsive to engine temperature is connected to a capacitor in said multivibrator means to determine the time constant thereof.

8. An apparatus as defined by claim 7, wherein said means responsive to engine temperature includes a transistor (T6) whose collector is connected to a negative supply line and whose base receives a signal dependent upon engine temperature and whose collector is connected in series with a resistor and a diode with said capacitor in said multivibrator means.

9. An apparatus as defined by claim 7, wherein said means responsive to engine temperature includes two resistors connected in series between the positive and negative circuit supply lines, the junction of said resistors receiving said signal dependent on engine temperature and said junction being connected through a diode to said capacitor in said multivibrator means.

10. An apparatus as defined by claim 1, wherein said multivibrator means includes a timing capacitor, and a transistor (T3), and further includes a diode (D3) connected between said capacitor and said transistor (T3), the junction of said capacitor and said diode being connected to a positive supply line via an adjustable resistor.

11. An apparatus as defined by claim 1, further comprising a circuit for generating output pulses of minimum duration and a gating circuit for receiving the output from said circuit for generating pulses of minimum duration and from said multivibrator means, said gating means including two sequential transistors (T7, T8), the transistor (T7) of said gating circuit being controlled through a first resistor (R19) from the joined output of said multivibrator means and of said circuit for generating pulses of minimum duration and also being controlled through a second resistor (R24) by said control pulses.

12. An apparatus as defined by claim 11, wherein said circuit means actuated by engine starting includes a first transistor (T4') whose collector is connected through a diode (D8) with the input of a transistor (T6) for blocking during the engine starting and the collector of said transistor (T4') is also connected through a diode (D6) with an input of said means for generating control pulses to shorten the duration thereof.

13. An apparatus as defined by claim 1, wherein said means responsive to engine temperature includes a temperature sensitive element located for thermal conduction with the cooling medium of said internal combustion engine and includes a series connection of an adjustable resistor, a diode and a fixed resistor, the junction of said diode and said fixed resistor being connected to the base of a transistor (19) whose output carries said variable signal.

* * * * *